US008668474B2

(12) United States Patent
Boey et al.

(10) Patent No.: US 8,668,474 B2
(45) Date of Patent: Mar. 11, 2014

(54) ELECTRO-ACTIVE VALVELESS PUMP

(75) Inventors: Yin Chiang Boey, Singapore (SG); Jan Ma, Singapore (SG)

(73) Assignee: Nanyang Technological University, Singapore (SG)

( * ) Notice: Subject to any disclaimer, the term of this patent is extended or adjusted under 35 U.S.C. 154(b) by 0 days.

(21) Appl. No.: 13/178,066

(22) Filed: Jul. 7, 2011

(65) Prior Publication Data

US 2011/0268594 A1 Nov. 3, 2011

Related U.S. Application Data

(63) Continuation of application No. 11/248,190, filed on Oct. 13, 2005, now abandoned.

(51) Int. Cl.
*F04B 17/00* (2006.01)

(52) U.S. Cl.
USPC ..... 417/413.2; 417/240

(58) Field of Classification Search
USPC ..... 417/413.2, 240
See application file for complete search history.

(56) References Cited

U.S. PATENT DOCUMENTS

| | | | | |
|---|---|---|---|---|
| 3,743,446 | A * | 7/1973 | Mandroian | 417/240 |
| 4,731,076 | A | 3/1988 | Noon et al. | |
| 4,738,493 | A | 4/1988 | Inagaki et al. | |
| 5,399,930 | A | 3/1995 | Culp | |
| 5,712,066 | A | 1/1998 | Yoshinaga et al. | |
| 5,961,298 | A | 10/1999 | Bar-Cohen et al. | |
| 6,074,178 | A | 6/2000 | Bishop et al. | |
| 6,203,291 | B1 | 3/2001 | Stemme et al. | |
| 6,679,687 | B2 | 1/2004 | Gharib | |
| 6,716,002 | B2 | 4/2004 | Higashino | |
| 6,752,601 | B2 | 6/2004 | Takeuchi et al. | |
| 6,827,559 | B2 | 12/2004 | Peters et al. | |
| 6,869,275 | B2 | 3/2005 | Dante et al. | |
| 6,910,869 | B2 | 6/2005 | Ng et al. | |
| 2003/0215342 | A1 | 11/2003 | Higashino et al. | |
| 2004/0086400 | A1 | 5/2004 | Blakley | |
| 2004/0155559 | A1 | 8/2004 | Ifuku et al. | |
| 2005/0275494 | A1 | 12/2005 | Gharib et al. | |
| 2005/0275696 | A1 | 12/2005 | Miyazawa et al. | |
| 2006/0062000 | A1 | 3/2006 | Peterson | |
| 2006/0083639 | A1 | 4/2006 | Liu et al. | |

FOREIGN PATENT DOCUMENTS

| | | |
|---|---|---|
| CN | 1558114 | 12/2004 |
| CN | 1594883 | 3/2005 |
| DE | 19536491 | 4/1997 |
| EP | 6181114 | 10/1994 |
| JP | 2000329073 | 11/2000 |
| WO | WO 2004/090335 | 10/2004 |

OTHER PUBLICATIONS

Auerbach et al., "An Analytic Approach to the Liebau Problem of Valveless Pumping," Cardiovascular Engineering: an International Journal, vol. 4, No. 2, Jun. 2004, Plenum Publishing Corporation, pp. 201-207.

Liebau, G., Part of Article from Kurze Originalmitteilungen, "Circle" Hospital Piene, 1954, pp. 327, and its unofficial translation.

* cited by examiner

*Primary Examiner* — Peter J Bertheaud
*Assistant Examiner* — Dnyanesh Kasture
(74) *Attorney, Agent, or Firm* — Preti Flaherty Beliveau & Pachios LLP

(57) ABSTRACT

An electro-active, valveless pump having a pumping chamber with at least one chamber wall. There is at least one opening in the at least one chamber wall. An electro-active actuator is located over each of the openings for inducing fluid flow.

9 Claims, 3 Drawing Sheets

ELECTRO-ACTIVE VALVELESS PUMP

CROSS REFERENCE TO RELATED APPLICATIONS

This application is a continuation application of U.S. application Ser. No. 11/248,190 filed Oct. 13, 2005, the whole of which is hereby incorporated by reference in its entirety.

FIELD OF THE INVENTION

This invention relates to an electro-active valveless pump and relates preferably, though not exclusively, as such a pump or use in, for or with micro-channels

BACKGROUND OF THE INVENTION

Valveless generation of unidirectional flow was first experimentally proven by Gerhart Liebau in 1954 ("Uber ein ventilloses pumpprinzip", Naturwissenschaften, 41,327, 1954). The effect is called the Liebau effect. However, such pumps are generally bulky, can only perform in a limited range of frequencies, are generally electromagnetically driven, and tend to have a high power consumption. For microfluidic flow systems, electroosmatic flow is often used. But it gives a very low flow rate.

SUMMARY OF THE INVENTION

In accordance with a first preferred aspect there is provided an electro-active, valveless pump having a pumping chamber with at least one chamber wall. There is at least one opening in the at least one chamber wall. An electro-active actuator is located over each of the openings for inducing fluid flow.

The electro-active actuator may be an electro-active element. The electro-active element may be either a piezoelectric material or an electrostrictive material. The electro-active actuator may be bimorph, unimorph, or monomorph. The electro-active activator may also have a membrane. The membrane may be of a polymeric ferroelectric material. The electro-active actuator may further comprise an actuator.

There may be a plurality of openings each with an electro-active actuator, the plurality of openings being arranged in the chamber wall longitudinally, circumferentially or longitudinally and circumferentially.

The plurality of electro-active actuators may be operated in a manner selected from: in phase for increasing fluid flow, out of phase for increasing fluid flow, in phase for decreasing fluid flow, and out of phase for increasing fluid flow. The relative locations of the electro-active actuators and their relative phase of operation may be used to control whether there is an increase or decrease in fluid flow.

The conduit may be a mircrofluidic channel in a channel body. The electro-active actuator may be mounted to the channel body relative to the microfluidic channel in a manner of a bridge, a cantilever, or an exciter.

The electro-active actuator may have a pair of oppositely-positioned electrodes. The electrodes may be in a multiple configuration for generating a relay effect for effecting fluid flow.

BRIEF DESCRIPTION OF THE DRAWINGS

In order that the present invention may be fully understood and readily put into practical effect, there shall now be described by way of non-limitative example only preferred embodiments of the present invention, the description being with reference to the accompanying illustrative drawings.

In the drawings.

DETAILED DESCRIPTION OF THE PREFERRED EMBODIMENTS

Figure 1:
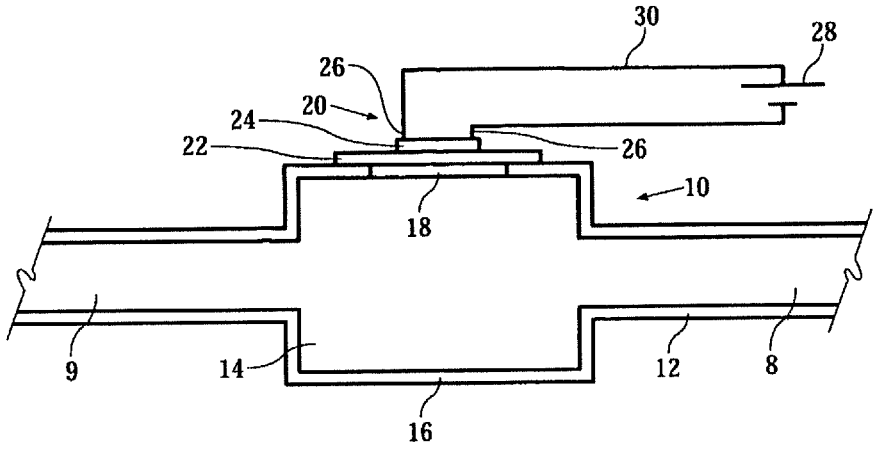
FIG. 1 is a longitudinal view of a first embodiment.

FIG. 1 shows a first embodiment of an electro-active, valveless pump 10 with an electro-active actuator 20. The pump 10 is fitted to a conduit 12. In this case it is fitted in-line, although this is not a requirement. The Liebau effect requires a mismatch in impedance in the conduit 12 so the pump 10 can induce movement of fluid in conduit 12 due to the impedance difference and the resulting wave interaction as the waves are reflected and may be subject to interference from reflected waves or waves generated by relay actuators. The different in impedance at the pump chamber may result from one or more of: different diameters, different materials, different internal shapes, different surfaces, and so forth. Furthermore, the pump 10 should be off-centre relative to the complete length of conduit 12. Alternatively, the mismatch in impedance may be created by the actuator 20 being placed off-centre so that the impedance mismatch is within the pump 20.

The pump 10 has a pump chamber 14 with a side wall 16, and an inlet 8 and an outlet 9. The chamber 14 is of a cross-sectional area shape that may be the same as that of conduit 12, or different to that of conduit 12. Also, for maximizing fluid flow it is preferably for pump chamber 14 to have a larger diameter than conduit 12. If the diameter of pump chamber 14 is less than that of conduit 12 fluid flow will be reduced.

Side wall 16 has an opening 18. Covering opening 18 is the electro-active actuator 20. The electro-active actuator 20 has a membrane 22 and an actuator 24. The actuator 24 is a piezoelectric or electrostrictive material and can take the form of a bimorph, unimorph or monomorph actuator. The actuator 24 may be made of a lead zirconate titanate ("PZT") material, or any other suitable ferroelectric material. It may be made by electrophoretic deposition, tape-casting, gel-casting, or sputtering. The actuator 24 may be the membrane 22 if the membrane 22 is of a polymeric ferroelectric material.

The membrane 22 may be of an elastic material such as, for example, silicon rubber, and is securely attached to side wall 16 surrounding opening 18.

Figure 5:
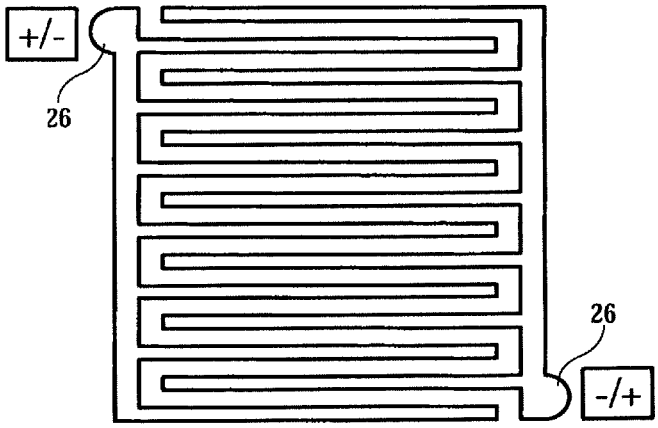
FIG. 5 is a schematic illustration of one form of electrode connection.

The actuator 24 has a pair of oppositely-positioned electrodes 26 that may be in single or multiple configurations for the generation of a relay effect to enhance fluid flow. The frequency of operation is preferably in the range of tenths of KHz with the frequency chosen, and the amplitude, impacting on the flow rate. As the amplitude of the movement of the membrane is proportional to the voltage applied to the actuator 24, the fluid flow rate can be controlled by controlling the voltage applied to the actuator. As shown in FIG. 5, if the electrodes 26 are on the same side of the actuator 24 will have the form shown. If not, they will be on the top and bottom of actuator 24.

Also, the frequency of operation of actuator 24 determines directly the frequency of movement of membrane 22 and thus the pumping frequency. The dimensions and material of pump chamber 14 and conduit 12 will also impact on the optional flow rate.

Power for the pump 10 may be from any suitable power source 28 such as, for example, a battery, and power is supplied to terminals 26 by cables or wires 30.

Figure 2:
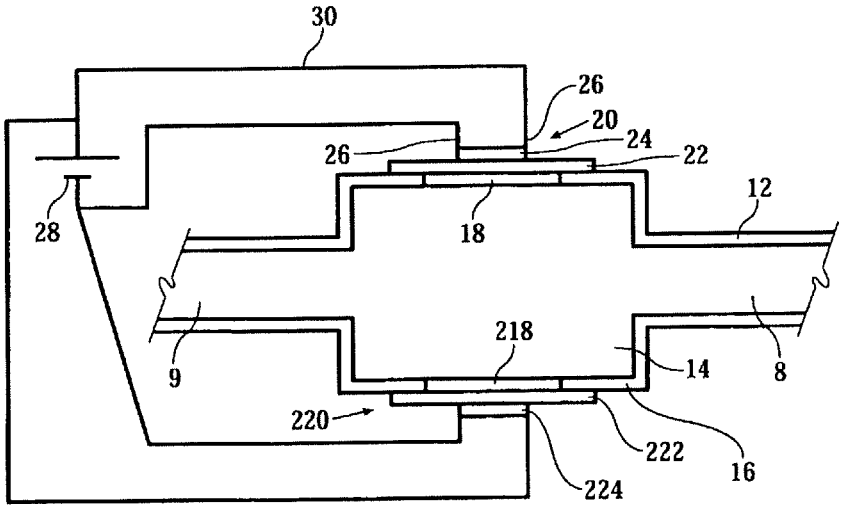
FIG. 2 is a longitudinal vertical cross-sectional view of a second embodiment.

FIG. 2 shows a second embodiment where the chamber wall 16 has a second opening 218 with a second electro-active actuator 220 arranged circumferentially of the first opening 20. The second opening 218 is preferably the same size and shape as the first opening 18, and is more preferably opposite the first opening 18. The second electro-active actuator 220 is preferably the same as the first electro-active actuator 20. However, the second actuator 220 may be of a different size and shape to the first actuator 20, and need not be opposite the first actuator 20.

In this way by operating the two actuators 20, 220 in phase, controlling the diameter of chamber 14, the frequency and amplitude of the voltage applied to the actuators 20, 220, a synergistic effect will be created with an increase in fluid flow rate.

Figure 3:
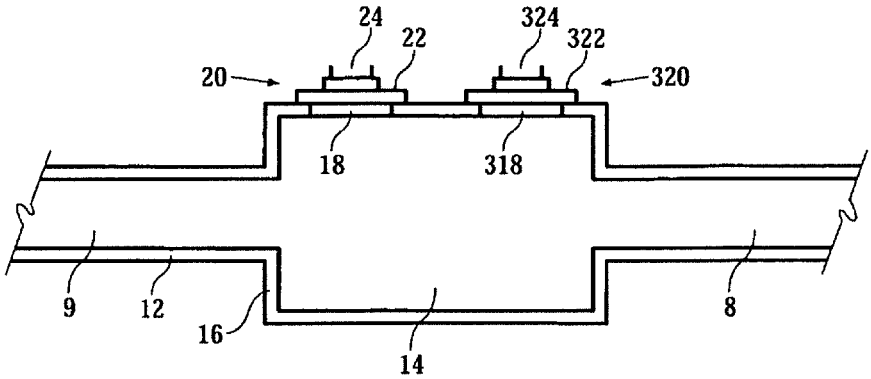
FIG. 3 is a longitudinal vertical cross-sectional view of a third embodiment.

FIG. 3 shows a third embodiment where the chamber wall 16 has a second opening 318 that is separated longitudinally from the first opening 18. The second opening 318 has a second actuator 320. The second opening 318 is preferably the same size and shape as first opening 18; and the second electro-active actuator 320 is preferably the same as the first electro-active actuator 20. However, the second actuator 320 may be of a different size and shape to the first actuator 20.

The spacing of the second opening 318 from the first opening 18 may be a full wavelength, or a whole-number multiple of a full wavelength, or may be part of a wavelength, or a multiple thereof. If the second actuator 320 is at the same side of chamber 14, and, in the first case, the second actuator 320 will be in phase with the first actuator 20; but in the second case the second actuator 320 will need to be proportionately out of phase with the first actuator 20 so that the pumping effects accumulate to increase third flow rather that to negate each other.

Figure 7:
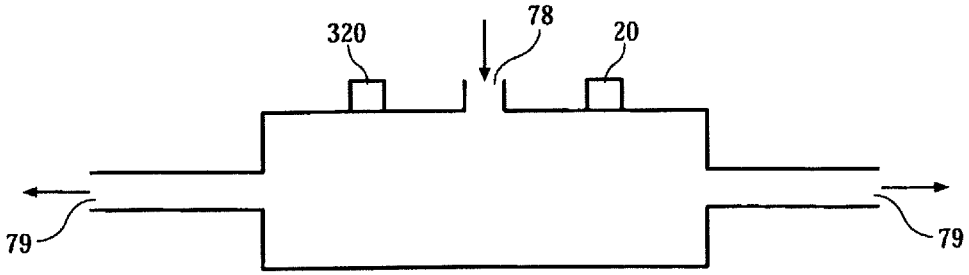
FIG. 7 is a longitudinal vertical cross-sectional view of a second embodiment.

But if the second actuator 320 is not at the same side of chamber 14, if the two actuators 20, 320 are in phase the flow will be reduced or even eliminated. In this case it is possible to have the configuration shown in FIG. 7 where the inlet 78 is at the centre, and the outlets 79 are at each end of the chamber 14.

Figure 4:
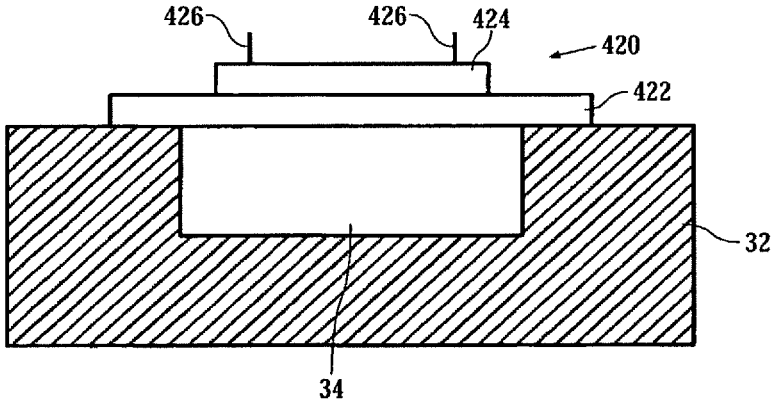
FIG. 4 is a transverse cross-section of a fourth embodiment.

Naturally, there may be more than two openings and electro-active actuators; and the arrangement may be a combination of the embodiment of FIGS. 2 and 3 with openings and actuators being located along and around pump wall 16. The relative locations of the plurality of electro-active actuators and their relative phase of operation may be used to control whether there is an increase or decrease in fluid flow FIG. 4 shows the situation where the conduit 12 is a microfluidic channel 34 in a channel body 32. The channel body 32 is preferably of a material such as, for example, polydimethyl siloxane ("PDMS"), glass, polymer, silicon wafer, or other elastic material. It may be made by standard production techniques including, but not limited to, soft lithography or spin coating.

In this case the movement of actuator 420 induces wave interaction in the channel body 32 with resultant flow in channel 34 as the waves are reflected, and may be subject to interference from reflected waves or waves generated by relay actuators.

Figure 6:
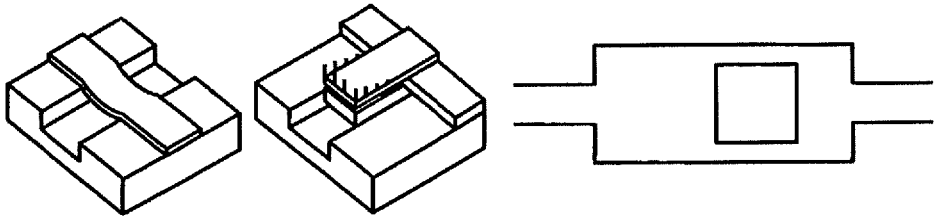
FIG. 6 is an illustration of three different forms of application of the fourth embodiment.

FIG. 6 shows three different ways of mounting the actuator 420 relative to body 32:

(a) bridge;

(b) cantilever; or (c) exciter.

For the embodiment of FIGS. 4 and 6, the membrane 22 may have a thickness in the range 50 to 400 micros. However, any suitable thickness may be used depending on the specific circumstances of the case.

The pump 10 may be able to be made relative small so it may be used for biomedical application, drug delivery (e.g. insulin pump), pumps implanted in the human or animal body for drug delivery and/or body fluid removal, a pump for cooling fluids for microprocessors and/or printed circuit boards, and so forth.

As the actuator 20 is a piezoelectric or electrostrictive, the power consumption is low thus giving long battery life. As it is not electromagnetic, it is suitable for use in sensitive locations such as, for example, hospitals, aircraft, and so forth.

Whilst there has been described in the foregoing description preferred embodiments of the present invention, it will be understood by those skilled in the technology concerned that many variations or modifications in details of design or construction may be made without departing from the present invention.

The invention claimed is:

1. An electro-active, valveless pump fitted to or integral with an inlet portion and an outlet portion of a conduit, wherein the pump is located between the inlet and outlet portions, the pump comprising:

(a) a pumping chamber comprising at least one pumping chamber wall and having a straight channel which joins two openings of equal size, each of said two openings being at a respective end of the channel, wherein the inlet portion of the conduit is coupled to one opening of said two openings and the outlet portion is coupled to the other opening of said two openings, and wherein the pumping chamber comprises a uniform cross-section in a flow direction from the inlet portion to the outlet portion;

(b) a single through hole in the at least one pumping chamber wall; and (c) a fluidless electro-active actuator comprising a membrane covering the single through hole for inducing fluid flow according to the Liebau effect, the electro-active actuator forming part of the pumping chamber wall against which fluid in the conduit flows, wherein the single through hole is arranged in the pumping chamber wall in a manner such that the single through hole is located off-center when viewed in an oscillation direction of the actuator relative to a length of the channel from one of said two openings to the other of said two openings in the pumping chamber, wherein the inlet and outlet portions of the conduit are of equal length and each presents a same impedance to the pumping chamber, and wherein the inlet portion has a first axis of symmetry and the outlet portion has a second axis of symmetry and the first and second axes of symmetry are co-axial.

2. An electro-active, valveless pump as claimed in claim 1, wherein the electro-active actuator comprises an electro-active element selected from the group consisting of: piezoelectric material and electrostrictive material.

3. An electro-active, valveless pump as claimed in claim 2, wherein the electro-active actuator is of a form selected from the group consisting of: bimorph, unimorph, and monomorph.

4. An electro-active, valveless pump as claimed in claim 1, wherein the membrane is of a polymeric ferroelectric material.

5. An electro-active, valveless pump as claimed in claim 1, wherein the conduit is a microfluidic channel in a channel body.

6. An electro-active, valveless pump as claimed in claim 5, wherein the electro-active actuator is mounted to the channel body relative to the microfluidic channel in a manner selected from the group consisting of: bridge, cantilever, and exciter.

7. An electro-active, valveless pump as claimed in claim 1, wherein the electro-active actuator comprises a pair of oppositely-positioned electrodes.

8. An electro-active, valveless pump as claimed in claim 7, wherein the electrodes are in a multiple configuration for generating a relay effect for enhancing fluid flow.

9. A microfluidic channel incorporating an electro-active, valveless pump as claimed in claim 1.

* * * * *